United States Patent [19]

Karr et al.

[11] Patent Number: 4,501,197

[45] Date of Patent: Feb. 26, 1985

[54] SUPERCALENDER EDGE NIP RELIEVING

[75] Inventors: Gerald W. Karr, South Beloit, Ill.; Gernot Müller, Kusterdingen, Fed. Rep. of Germany

[73] Assignee: Beloit Corporation, Beloit, Wis.

[21] Appl. No.: 543,167

[22] Filed: Oct. 19, 1983

[51] Int. Cl.[3] ..... B30B 3/04

[52] U.S. Cl. ..... 100/35; 100/47; 100/162 R; 100/168

[58] Field of Search ..... 100/35, 47, 161, 162 R, 100/163 R, 164, 168, 170

[56] References Cited

U.S. PATENT DOCUMENTS

| | | | |
|---|---|---|---|
| 2,985,100 | 5/1961 | Hornbostel | 100/163 R |
| 3,180,251 | 4/1965 | Tidbury | 100/170 X |
| 3,364,848 | 1/1968 | Müller | 100/47 |
| 3,369,483 | 2/1968 | Müller | 100/47 |
| 3,554,118 | 1/1971 | Laine | 100/163 |
| 3,584,570 | 6/1971 | Sass | 100/163 |
| 4,290,351 | 9/1981 | Pav et al. | 100/47 |
| 4,311,091 | 1/1982 | Pav et al. | 100/161 |
| 4,375,188 | 3/1983 | Leiviskä | 100/162 R |

FOREIGN PATENT DOCUMENTS 2101374 6/1974 Fed. Rep. of Germany .

*Primary Examiner*—Peter Feldman

*Attorney, Agent, or Firm*—Hill, Van Santen, Steadman & Simpson

[57] ABSTRACT

A calender and method of operating the same, where the calender has a vertical stack of a plurality of rotary rolls, each of the rolls having bearing structure at each opposite end provided with a thrust shoulder cooperative with a stop shoulder on a respective suspension spindle at each end of the rolls. There are guideways for the bearing structures, and there is an arrangement for vertically shifting the rolls between a lowered mode for spaced apart independent suspension by stop shoulders and a raised nipping mode relation with one another. The weight of the bearing structures of the rolls in the raised nipping mode relation is relieved as by cooperating pawl and rack structure.

19 Claims, 7 Drawing Figures

SUPERCALENDER EDGE NIP RELIEVING

BACKGROUND OF THE INVENTION

1. Field of the Invention

The present invention relates to supercalenders of the type wherein the rolls are adapted for limited separation from one another in one mode and are in calendering nipping engagement with one another in another mode.

2. Description of the Prior Art

Supercalenders with which the present invention is concerned are well known in the art and comprise a substantial stack of calender rolls wherein separation of the rolls may be controlled either from the top or the bottom of the stack. Where control is from the bottom of the stack, a king roll at the bottom of the stack is moveable between a lowered position and a raised position. In the lowered position of the king roll, a substantial number of calender rolls thereabove separate from one another to provide gaps therebetween to facilitate threading a new web of material through the stack or to relieve any damaging effect of broke or creased web passing through the roll nips. As thus gapped, the opposite ends of the rolls are supported by their bearing structures on shoulders along upright suspension spindles at the opposite sides of the stack. In the calendering mode of the stack, the king roll acting through the next adjacent calendering roll pushes all of the rolls thereabove into nipping relation, wherein the bearing structures for the rolls are lifted from the spindle shoulders. For uniform nip loading, the topmost roll in the stack may be hydraulically biased downwardly. Calenders of the type just described are represented in U.S. Pat. Nos. 3,364,848, 3,369,483, 4,290,351 and 4,311,091.

Inasmuch as the calender rolls are quite heavy, such, for instance as about 42,000 pounds each in a supercalender, their bearing structures must be fairly massive to afford adequate support when the rolls are individually supported on the spindles. Typically each bearing structure at each end of each of the rolls may weigh from 4,000 to 5,000 pounds. Therefore, when the rolls are lifted to the nipping, calendering mode, and the bearing structures are in deadweight relation at each end of each roll, the deadweight end loads on the rolls tend to distort the rolls and thus distort nips between rolls from the ideal straight line. This distortion or warping condition is aggravated where, as is often desirable, fly rolls (i.e. guide rolls) are supported on the housings of the bearing structures.

SUMMARY OF THE INVENTION

It is to the alleviation of the distortion of the roll nips due to deadweight of the bearing structures that the present invention is directed.

To this end, the present invention provides a method of operating a calender having a vertical stack of a plurality of rotary rolls, each of the rolls having bearing structure at each opposite end, means for guiding the bearing structures for vertical movement, and means for vertically shifting the rolls between a spaced apart independent suspension mode and a nipping mode relation with one another and comprising relieving the weight of the bearing structures of the rolls in the nipping mode relation of the rolls by operating lifting pawls in cooperation with associated racks.

For practicing the method, the present invention provides a calender having a vertical stack of a plurality of rotary rolls, each of the rolls having bearing structure at each opposite end means for guiding the bearing structures for vertical movement, and means for vertically shifting the rolls between a spaced apart independent suspension mode and a nipping mode relation with one another, and comprising means including lifting pawls which cooperate with associated racks for relieving the weight of the bearing structures from the rolls in the nipping mode relation, and means for operating the relieving means.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which.

DETAILED DESCRIPTION

Figure 1:
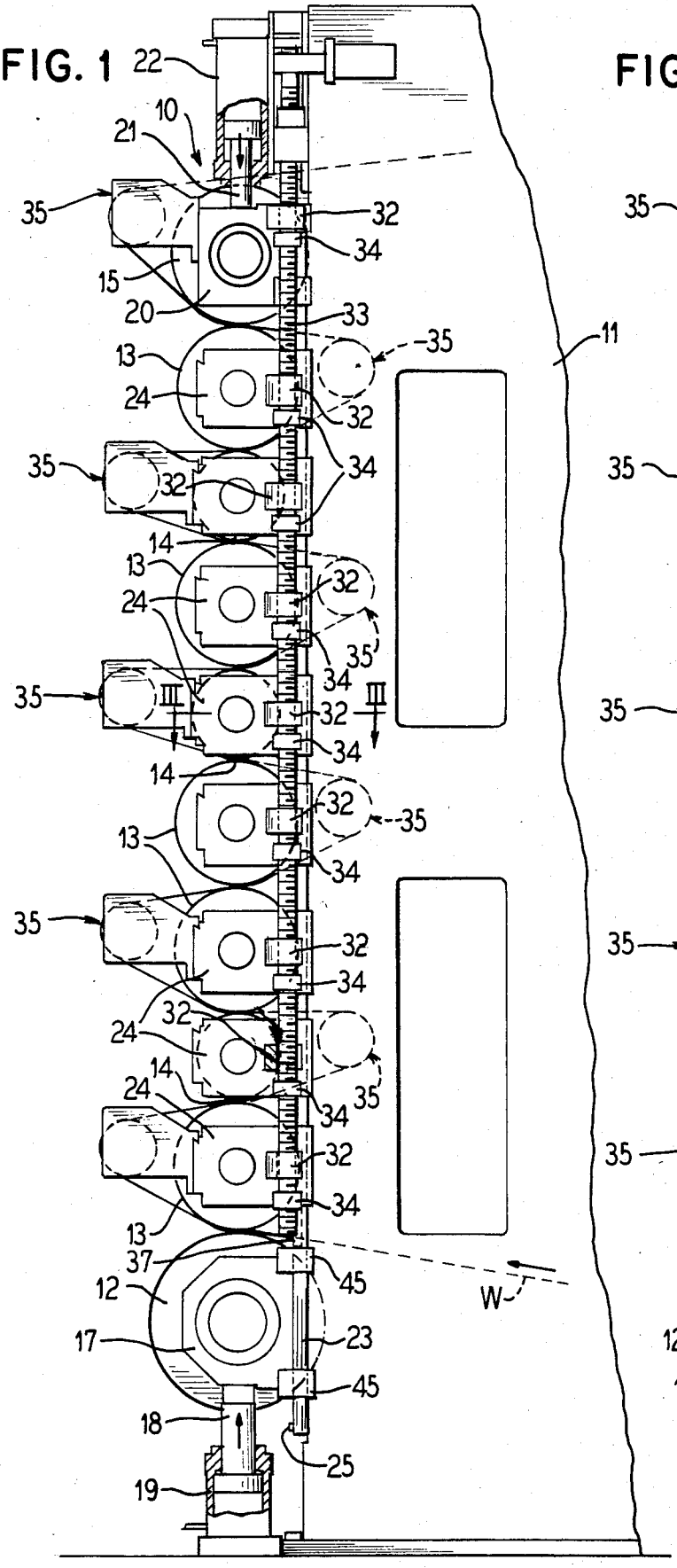
FIG. 1 is a more or less schematic side elevational view of a supercalender embodying the invention and showing the rolls in the calendering mode.
Figure 2:
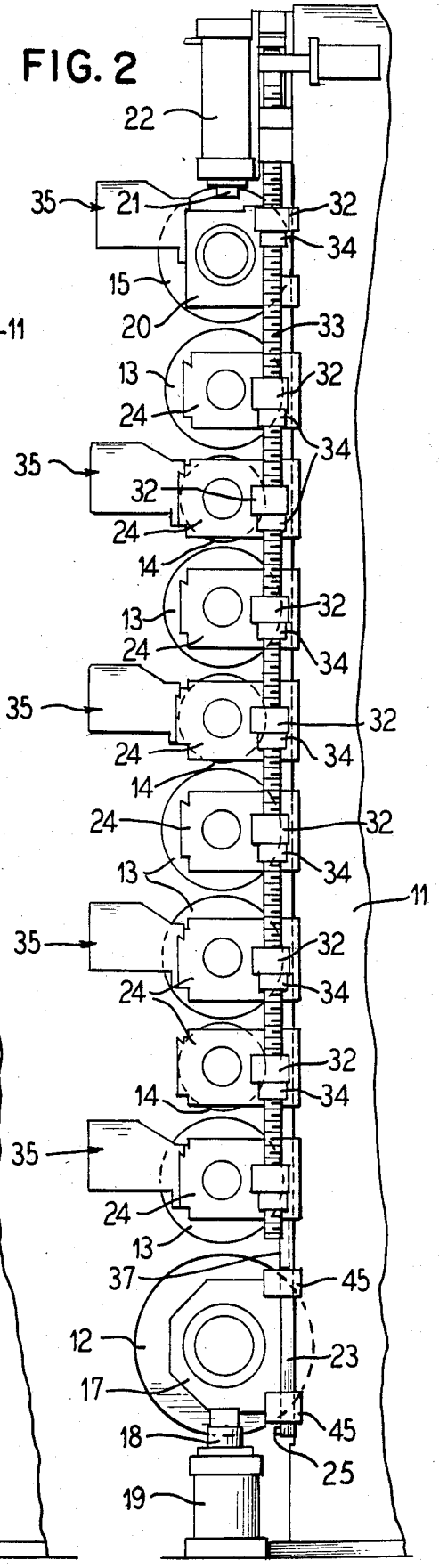
FIG. 2 is a similar view showing the rolls in the open or spaced apart mode of the rolls.

Referring to FIGS. 1 and 2, one side of a supercalender is depicted wherein a vertical stack of calender rolls 10 is supported in respect to a supporting frame 11. Only one side of the calender is depicted, and it will be understood that the opposite side will be substantially mirror image of the illustrated side, and the description will assume such substantial similarity of both sides, and thus the substantial similarity of the structures involved at each opposite end of each of the calender rolls in the stack 10.

The calender stack 10 comprises a lowermost king roll 12 and thereabove a series of filled (i.e. composed of a core supporting a concentric pack of cotton, paper or fibrous disks) rolls 13, and cast iron rolls 14 which, in general are alternated in the stack, except near the center of the stack where a pair of the filled rolls 13 have nipping relation with one another so that a web W being calendered will be exposed to the smoothing action of these filled rolls on both sides. At the top of the stack a head roll 15 (FIG. 1) bears downwardly on the stack of rolls in the calendering mode for attaining substantially uniform nipping pressure between all of the rolls in the stack.

Although in some calenders the topmost roll serves not only as a pressure roll but also as a lifting roll by which all of the rolls except the lowermost roll are lifted into nip separating relation, the preferred arrangement shown in FIGS. 1 and 2, has the lower or king roll 12 in control of both the calendering mode as shown in FIG. 1 and the open roll mode shown in FIG. 2. For this purpose supporting bearing means 17 at each end of the king roll 12 have associated therewith upwardly thrusting hydraulic plungers 18 of hydraulic cylinders 19 adapted to thrust the king roll 12 upwardly as shown by directional arrow FIG. 1 for the calendering mode, and to drop the king roll 12 rapidly for the open roll mode as shown in FIG. 2. On the other hand, the top roll 15 has its bearing structures 20 at each opposite end adapted to be thrust downwardly by means a respective hydraulic actuator piston plunger 21 having its hydraulic cylinder 22 mounted on the frame 11 in each instance. The actuators 22 are adapted to be activated after the hydraulic actuators 19 have raised the king roll 12 into the calendering mode for attaining the desired substantial uniformity of calendering load on the stack. As shown in FIG. 2, in the open roll mode the actuators 22 are inactivated.

For guiding all of the rolls in the stack 10 for vertical movement along the supporting structure frame 11 a vertical rail 23 is provided which extends the full length from top to bottom of the stack and is adapted for slidable tracking engagement with the housings of the bearings of the several rolls. Each of the rolls 13 and 14 has a similar bearing structure 24. All of the bearing housings for all of the bearing structures 24 and the bearing structures 17 and 20 may be slidably engaged with the rail 23 as typically illustrated in FIG. 3. The rail 23 is secured to the frame 11 as by means of bolts 25 at suitable intervals therealong. Bearing housing 27 has vertical bearing surfaces 27*a* in tracking engagement with the rail 23 in cooperation with retainer plates 28 secured to the housing 27 by means of bolts 29. Roller bearings 30 support the associated journal 31 of the calender roll on the bearing housing 27 which is of a mass and durability suitable for the purpose.

Each of the bearing housings 27 for each of the bearing structures 20 and 24 has an integral yoke 32 within which the shank of a threaded screw spindle 33 is received, the yoke providing a thrust shoulder facing toward and engageable with an underlying supporting stop shoulder 34 in the form of a stop nut threadedly engaged on the spindle 33 and readily adjustable therealong. Each of the stop nuts 34 is adapted to be adjusted to attain the desired spacing between its associated roll and the contiguous rolls. In a preferred relationship, such spacing may be progressively greater from the uppermost roll nip to the lowermost roll nip. For example, at the uppermost nip the spacing may be about one-half inch, and the spacing of each successive nip downwardly in the stack may increase by about 0.2 inch increment so that in a stack having the number of rolls shown the lowermost nip spacing in the open condition of the rolls may be about 2.1 inch. This facilitate threading or any other web condition or event, where the web travels upwardly through the calender. Each of the spindles 33 is thoroughly anchored at the top of the frame 11.

Even though the bearing structures 20 and 24 may be heavy enough in and of themselves to cause a nip distortion by reason of their deadweight in the closed nipping roll mode as depicted in FIG. 1, the problem is aggravated where it may be preferred to mount fly roller assemblies 35 on the housings 27 of the bearing structures for each of the rolls above the king roll 12. Such mounting of the fly rollers 35 (also sometimes referred to as guide rollers) is desirable because thereby the fly rollers remain in the most desirable alignment with respect to the associated calender roll in each instance, and when the rolls in the stack are rapidly dropped to open the nips, there is minimum, if any, distorting tension of the web W.

Figure 5:
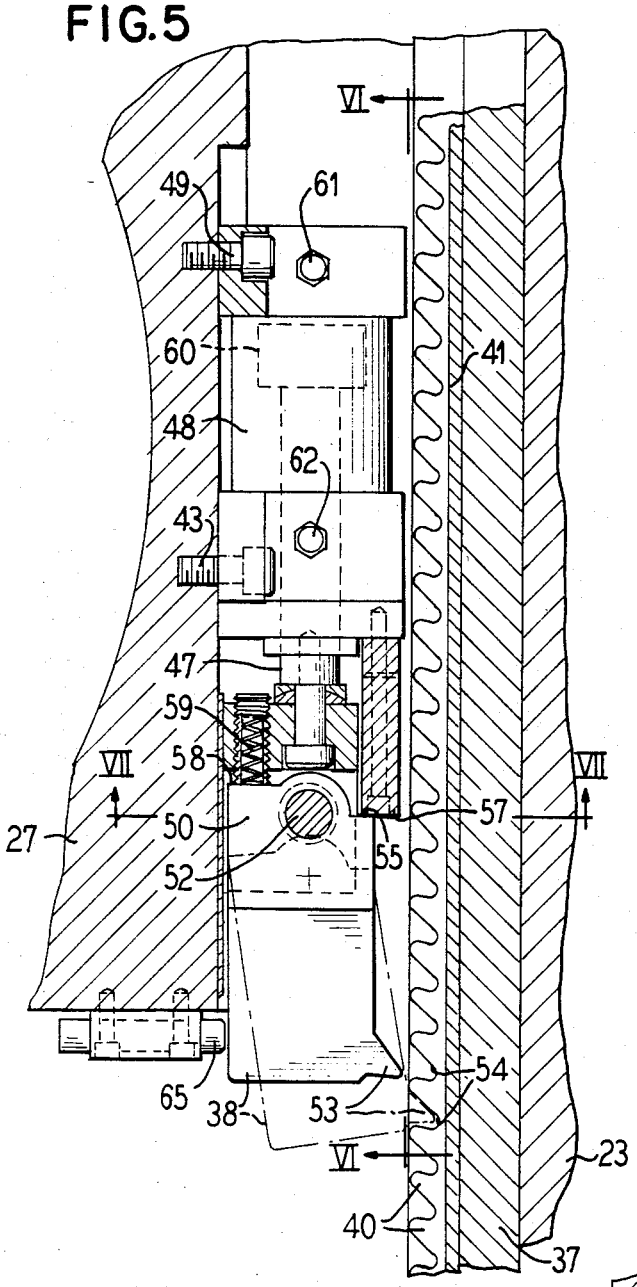
FIG. 5 is a fragmentary sectional elevational detail view taken into substantially the same plane as FIG. 4 but showing certain features in enlarged detail.
Figure 6:
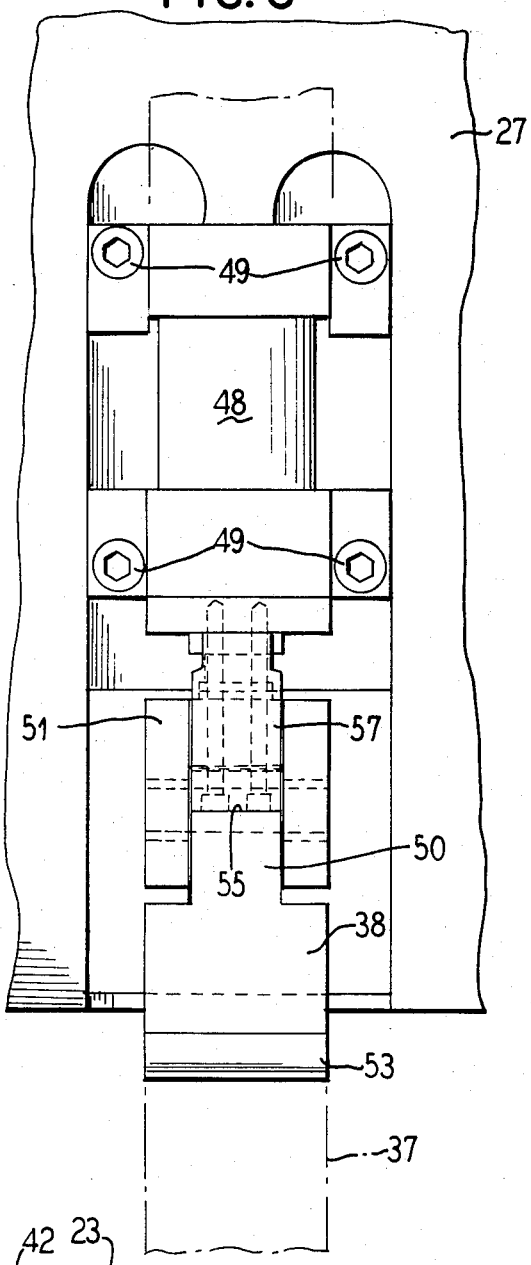
FIG. 6 is a fragmentary elevational view taken substantially in the plane of line VI—VI in FIG. 5.

According to the present invention, the weight of the bearing structures 20 and 24 is relieved from the rolls 13, 14 and 15 in the raised nipping mode relation of the calender rolls, that is, the mode illustrated in FIG. 1. This is effected, for example, by means illustrated in FIGS. 3–7, including rack means 37 conveniently in the form of an elongate rack bar associated with each of the track members 23 and selectively engageable by a pawl 38 carried by the bearing housing 27. As indicated hereinabove, this arrangement prevails with equal effect at each side of the calender stack, and more particularly at each of the ends of the calender rolls. The arrangement is such that when the king roll 12 raises the calender rolls thereabove into their nipping, calendering relation, the rack bar 37 is engaged by the pawl 38 as shown in dot dash outline in FIG. 5. By the coupling thus provided the deadweight load of the associated bearing structure is relieved from the associated end of the calender roll. When the calender rolls are dropped to provide gaps at their nips, in the mode illustrated in FIG. 2, and the weight of the calender rolls is supported through their bearing structures on the shoulders 34, the pawls 38 are adapted to freely disengage from the rack bars 37.

Figure 3:
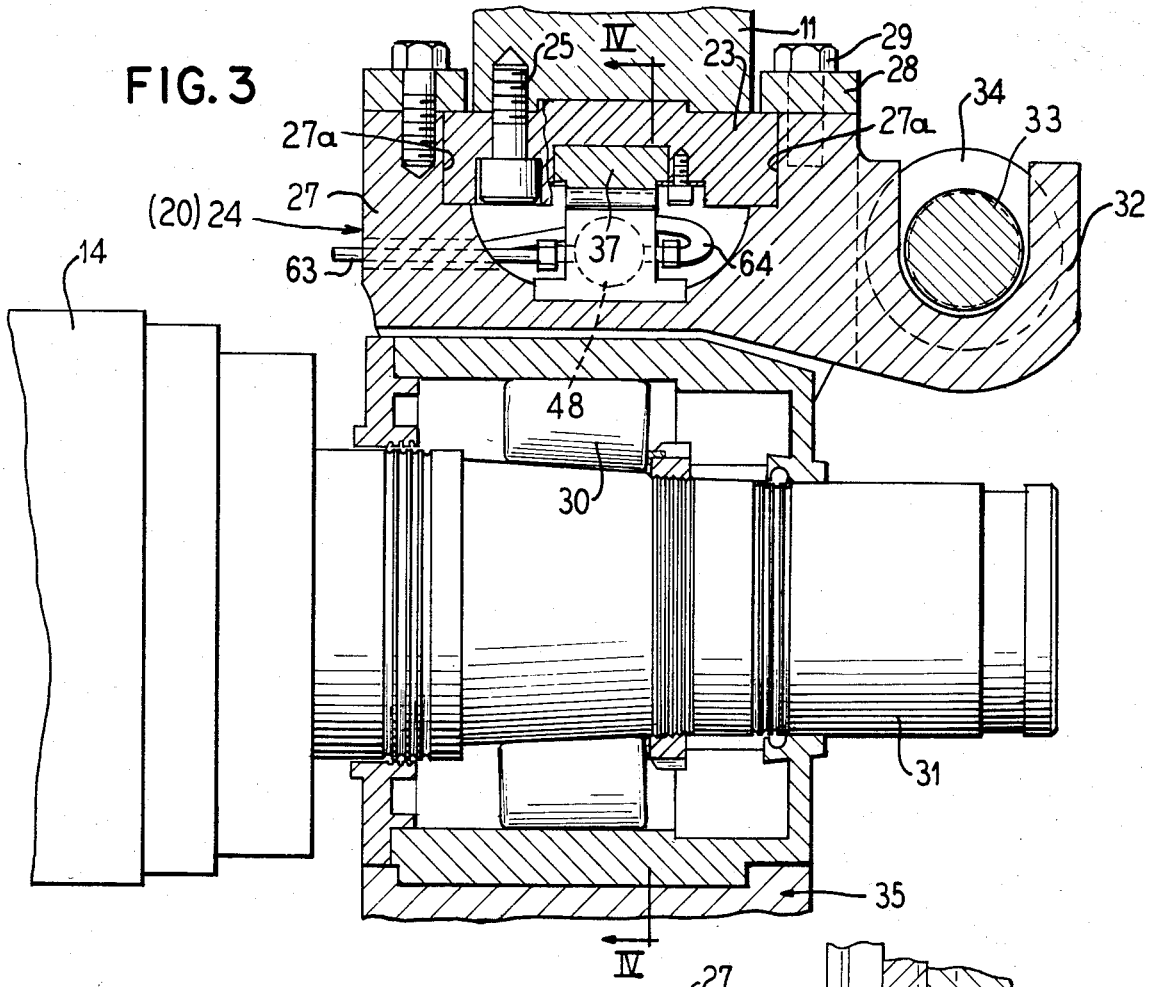
FIG. 3 is an enlarged fragmentary sectional plan detail view taken substantially along the line III—III in FIG. 1.
Figure 4:
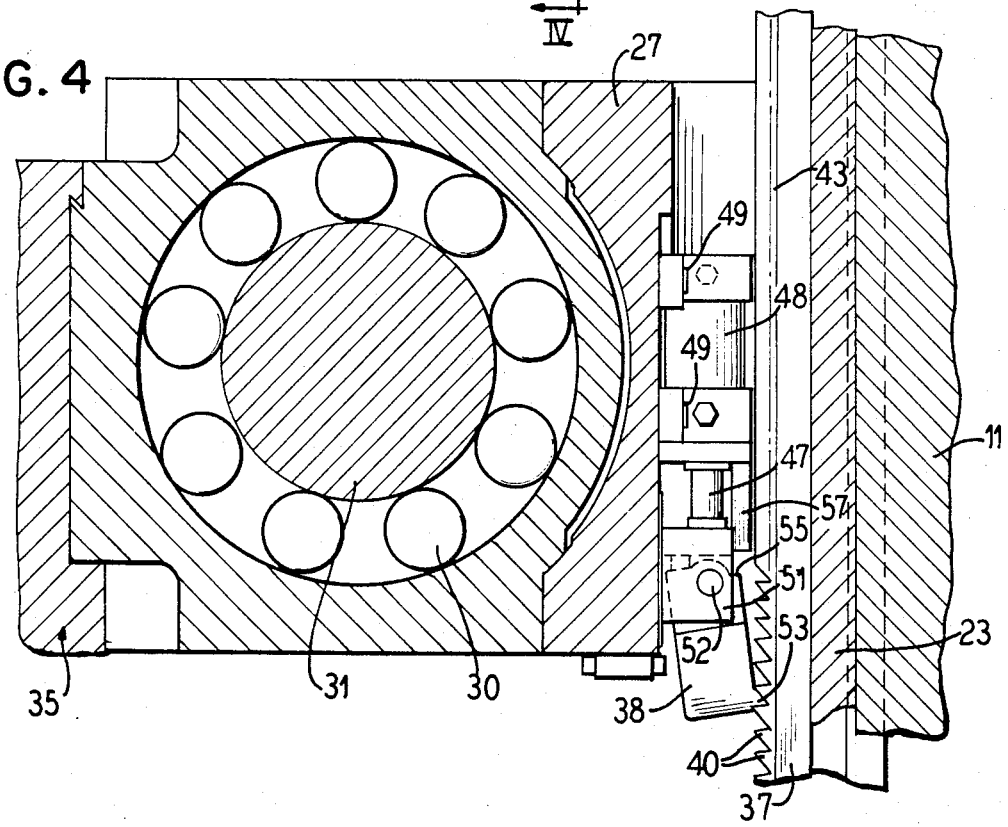
FIG. 4 is a vertical sectional elevational view taken substantially along the line IV—IV in FIG. 3.
Figure 7:
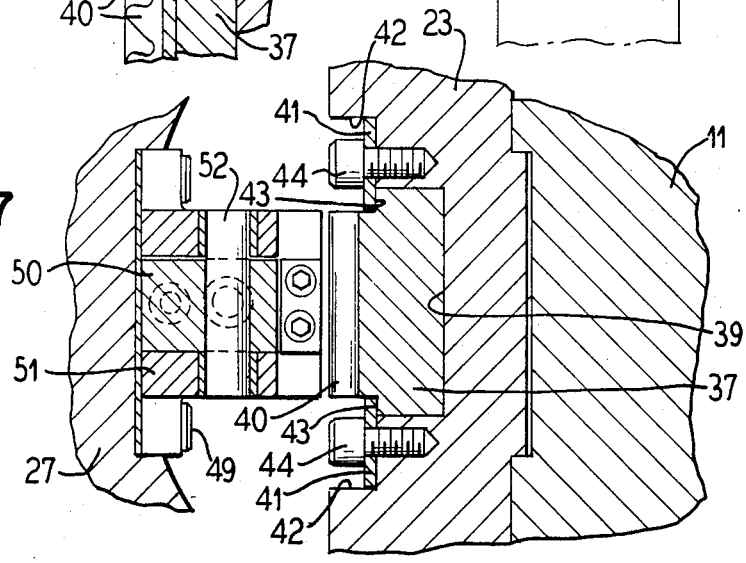
FIG. 7 is a fragmentary sectional plan view taken substantially along the line VII—VII in FIG. 6.

In a desirable arrangement, each of the rack bars 37 is slidably mounted in a complementary vertical recess 39 in the associated track member 23 and which is deep enough to receive the rack bar with rack teeth 40 thereof about flush with the outer face of the track member 23, as best visualized in FIGS. 3 and 7. Retainer strips 41 mounted in offset grooves 42 at the outer sides of the recess 39 and retained in overlapping retaining relation to lateral shoulders 42 extending longitudinally on the rack bar 37 inwardly alongside the rack teeth 40, are secured in place by means of screws 44. Through this arrangement, the rack bars 37 are retained in thoroughly backed up relation to the associated track members 23 and are permitted to slide vertically in their retaining recesses 39. At their lower ends, the rack bars 37 are adapted to thrust at each side of the calender stack against a stop shoulder 45 (FIG. 1) provided by the uppermost of a pair of vertically spaced runner bosses 45 integral with the housing of the bearing structure 17 of the king roll 12. These runner bosses 45 are in engagement with the track member 23 in similar fashion as shown in FIG. 3 for the bearing structure housing 27. As a result, when the king roll 12 is raised, the rack bars 37 are shifted upwardly in their track recess 39. When the king roll 12 is dropped, the rack bars 37 follow, at least by gravitational bias, their associated shoulder bosses 45 and descend therewith as guided in their tracks recesses.

Means are provided for controlling the pawls 38 individually in a manner to assure that the pawls will engage the rack teeth in each instance only when the calender roll system is ready for the deadweight relief function of the pawl and rack structure. To this end, each of the pawls 38 is carried by the lower end portion of a piston rod 47 of a rectilinear hydraulic actuator 48 mounted in vertical position to the bearing housing 27 in each instance. At its upper end portion, the pawl 38 is pivotally attached to the piston rod or plunger 47 by means of an ear 50 (FIGS. 5–7) which projects upwardly into a clevis 51 carried by the piston rod 47, with a sturdy pivot pin 52 effecting a pivotal connection so that the pawl 38 is adapted to swing into and out of ratcheting engagement with the teeth 40 of the rack 37. Such ratcheting engagement is facilitated by means of a finger 53 on the pawl complementary in shape to recesses 54 between the rack teeth 40 each of which provides an upwardly facing shoulder as shown. In the non-operating mode of the pawl 38, the actuator 48 draws the pawl upwardly into a raised position wherein a shoulder 55 on the upper end of the pawl at the side which is nearest the rack 37 engages a downwardly facing stop member 57 which may conveniently be carried by the lower face of the head of the actuator 48. Thereby the pawl 38 is positively swung toward the adjacent face of the housing 27 and is held in a position where the pawl finger 53 is clear of the rack teeth 40. In this retracted, inactive position of the pawl 38, an upwardly facing shoulder 58 on the upper end of the pawl, and at the opposite side of the pivot 52 from the shoulder 55, engages biasing means comprising a spring 59 which is compressed by the shoulder 58. Hydraulic fluid for operating the actuator 48 is delivered to opposite ends of its piston 60 through an upper inlet 61 and a lower inlet 62 (FIG. 5) to which respective alternating hydraulic pressure/relief conduits 63 and 64 are connected.

Operation of the hydraulic actuators 48 is coordinated with operation of the hydraulic actuators 19 for the king roll 12 and the actuators 22 for the top or head roll 50. When the king roll drops to open the calender rolls, the pawl actuators 48 retract the pawls. When the king roll has raised the calender rolls into nipping calendering relation, and the upper pressure roll 15 is activated to place calendering load on the stack, the pawl actuators 48 are operated to drive the pawls 38 downwardly. As the pawl shoulders 55 leave the stops 57, the biasing springs 59 swing the pawls 38 toward the associated racks 37 so that the pawl fingers 53 will engage with one of the teeth 40 of the rack. Then by continuing thrust applied by the actuators 48 to the associated pawls 38, a corresponding upward lifting force is applied to the associated bearing structures for relieving the deadload of the bearing structures from the associated calender rolls. This relieves the calender rolls from the distorting effect of the bearing structure and associated fly roll dead weight so that the rolls will maintain substantially uniformly straight calendering nips.

In order to avoid malfunction should any of the pawls 38 not retract properly when the calender roll stack is dropped, safety means comprising a proximity switch 65 (FIG. 5) is provided for each of the pawls 38 to monitor its retracting performance. If any of the pawls 38 does not properly retract, then this will be signalled at a control station, and the malfunction may be traced. This safety feature avoids the possibility that any pawl may remain in engagement with the rack 37 in the separated roll mode, whereby on lifting of the stack toward the calendering, nipping mode the entire weight of the associated roll might be imposed through the malfunctioning pawl onto the associated rack 37. Overburdening and possibly destructive imposition of weight on the rack 37 is thus avoided.

It will be understood that variations and modifications may be effected without departing from the spirit and scope of the novel concepts of this invention.

We claim as our invention:

1. A method of operating a calender having a vertical stack of a plurality of rotary rolls, each of said rolls having a bearing structure at each opposite end, means for guiding said bearing structures for vertical movement, and means for vertically shifting said rolls between a spaced apart independent suspension mode and a nipping mode relation to one another, and comprising:

relieving the weight of said bearing structures of said rolls in said nipping mode relation of said rolls by operating lifting pawls in cooperation with associated racks.

2. A method according to claim 1, which comprises shifting said racks out of engagement with said pawls in coordinated relation to vertically shifting of said rolls into the lowered mode.

3. A method according to claim 2, which comprises shifting said pawls into clearance relation to said racks in coordinated relation to said shifting of said racks.

4. A method according to claim 3, which comprises returning said rolls to the nipping mode relation, and then effecting return engagement of said pawls with said racks.

5. A method according to claim 4, which comprises after said pawls have returned to engagement with the racks, imparting a component of bearing structure lifting force to said pawls.

6. A method according to claim 1, which comprises effecting said relieving by hydraulically operating said pawls in coordinated relation with the lowering and raising of said rolls.

7. A method according to claim 1, which comprises shifting said racks selectively for disconnecting said pawls from said racks.

8. A method according to claim 7, which comprises shifting said racks vertically in coordinated relation with a vertically shiftable king roll at the lower end of the roll stack.

9. A method according to claim 1, which comprises relieving the weight of fly roller assemblies in addition to relieving the weight of said bearing structures.

10. A method according to claim 1, which comprises guiding said racks for vertical operating movement in vertical trackways associated with said roll bearing structures.

11. A calender having a vertical stack of a plurality of rotary rolls, each of said rolls having a bearing structure at each opposite end, means for guiding said bearing structures for vertical movement, and means for vertically shifting said rolls between a spaced apart independent suspension mode and a nipping mode relation to one another, and comprising:

means including lifting pawls which cooperate with associated racks for relieving the weight of said bearing structures from said rolls in said nipping mode relation;

and means for operating said relieving means.

12. A calender according to claim 9, wherein said bearing structures have fly roller assemblies associated therewith, and said means for relieving relieves not only the weight of the bearing structures but also the weight of said assemblies.

13. A calender according to claim 11, wherein said operating means has means for shifting said racks out of engagement with said pawls in coordinated relation to vertical shifting of said rolls into the lowered mode.

14. A calender according to claim 13, which comprises means for shifting said pawls into clearance relation to said racks.

15. A calender according to claim 14, wherein said means for shifting said pawls is adapted to retain said pawls in the clearance relation until said rolls have been returned to the nipping mode relation whereafter said pawl shifting means is adapted to operate the effect return engagement of the pawls with said racks.

16. A calender according to claim 1, wherein said pawl shifting means is adapted to operate for imparting a component of bearing structure lifting force to said pawls.

17. Apparatus according to claim 11, wherein said means for relieving comprise pawl driving and retracting, hydraulic actuators operable in coordinated relation with lowering and raising of said rolls.

18. A calender according to claim 11, wherein said stack of rolls comprises a vertically shiftable king roll at the lower end of the stack, and means controlled by said king roll for shifting said racks vertically in coordinated relation with shifting of said king roll.

19. A calender according to claim 11, comprising vertical track members providing said guiding means, vertically reciprocable rack bars slidably engaged within vertical track ways in said track members, means for reciprocating said rack bars in said track ways, and retractable pawls carried by said bearing structures for selective engagement with said rack bars.

* * * * *